US010702439B1

(12) United States Patent
Cavallaro et al.

(10) Patent No.: US 10,702,439 B1
(45) Date of Patent: Jul. 7, 2020

(54) ROBUST SOFT TEXTILE TRANSFER PACKAGE FOR CONTAMINATED MATERIALS WITH NON RIGID END TERMINATIONS

(71) Applicant: The United States of America as represented by the Secretary of the Navy, Newport, RI (US)

(72) Inventors: Paul V Cavallaro, Raynham, MA (US); Andrew W Hulton, Mansfield, MA (US); Gregory J Gudejko, Framingham, MA (US); Dustin T Green, Fredericksburg, VA (US); Fred W. A. H. Geurts, Methuen, MA (US); Michael G. Hainsworth, Nashua, NH (US); Thomas W Kloehn, Centreville, VA (US); Lucienne R Simone, Woodbridge, VA (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 16/381,208

(22) Filed: Apr. 11, 2019

Related U.S. Application Data

(63) Continuation-in-part of application No. 15/688,145, filed on Aug. 28, 2017, now Pat. No. 10,301,073.

(51) Int. Cl.
*A61G 17/06* (2006.01)
*A61G 17/007* (2006.01)
(Continued)

(52) U.S. Cl.
CPC ..... *A61G 17/06* (2013.01); *A61G 17/001* (2017.05); *A61G 17/007* (2013.01); *D03D 1/04* (2013.01)

(58) Field of Classification Search
CPC .... A61G 17/06; A61G 17/001; A61G 17/007; D03D 1/04
(Continued)

(56) References Cited

U.S. PATENT DOCUMENTS 1,383,955 A * 7/1921 Kiley ..... A01D 46/087 232/43.1
5,659,933 A * 8/1997 McWilliams ..... A61G 17/06 27/28

(Continued)

FOREIGN PATENT DOCUMENTS

FR 2717678 A1 * 9/1995 ..... A61G 17/06

*Primary Examiner* — Jes F Pascua
(74) *Attorney, Agent, or Firm* — James M. Kasischke; Michael P. Stanley

(57) ABSTRACT

A soft transfer case for contaminated material is provided. The transfer case includes a film-laminated, woven textile exterior layer as a pouch. The cylinder is capable of being clamped at each end of the cylinder. An open end elastomeric bladder for containing the contaminated material is contained by the exterior layer. The bladder includes a seam to seal the open end with the material contained therein. Upon pressurization of the bladder, the exterior layer expands and a restraining force is generated between the textile layer and the clamps. A variant of the soft transfer case provides soft end terminations formed by fold-over regions at fold lines in the exterior layer. The exterior layer is fitted with matching locking straps affixed along a longitudinal exterior. The locking straps mechanically lock together. Lifting handles are also affixed to the exterior strength layer to ease transport of the transfer case.

6 Claims, 11 Drawing Sheets

(51) Int. Cl.
*A61G 17/00* (2006.01)
*D03D 1/04* (2006.01)

(58) Field of Classification Search
USPC ..... 383/88, 89, 117
See application file for complete search history.

(56) References Cited

U.S. PATENT DOCUMENTS

| | | | | |
|---|---|---|---|---|
| 8,966,727 | B1 * | 3/2015 | Green | A61G 17/06 27/28 |
| 10,301,073 | B1 * | 5/2019 | Cavallaro | B65D 29/00 |
| 2016/0176622 | A1 * | 6/2016 | Vertsteylen | A61G 17/047 206/205 |

* cited by examiner

Plain Woven Fabric

ROBUST SOFT TEXTILE TRANSFER PACKAGE FOR CONTAMINATED MATERIALS WITH NON RIGID END TERMINATIONS

The present continuation-in-part application claims the benefit of U.S. patent application Ser. No. 15/688,145 filed on Aug. 28, 2017 which claims the benefit of U.S. Provisional Application 62/382,313 by the inventors, Paul V. Cavallaro, Andrew W. Hulton, Gregory J. Gudejko and Dustin T. Green and entitled "Robust Soft Textile Transfer Package for Contaminated Materials".

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention applies to the field of containers used in the transport of biologically or chemically contaminated hazardous contents.

(2) Description of the Prior Art

Current international standards impose strict requirements on the air transport of biologically and chemically hazardous materials. Existing container solutions are designed for small samples rather than larger contents. The maximum stress and stress distributions in larger containers vary considerably based on the size, shape and wall thickness of the container. While safe shipping requirements are attainable for small scale containers at a given internal pressure; larger scale containers encounter significantly higher stresses at the same internal pressure due to the increased volume of the container.

Also, significantly greater stresses are developed during drop impact and puncture tests due to the increased content and container weights. Working and shipping standards require a leak-proof seal without an allowance for pressure relief. While the container would likely never need to be re-opened after the insertion of the contaminated contents; ease of use in portability (a low weight) and the time to seal the container (sealing in less than 30 minutes) are desired.

As such, there is a need to increase transfer container sizes in order to accommodate the safe transport of contaminated human remains and other comparably sized contents. Performance metrics require that the containers be sealable within thirty minutes after the insertion of the contents; be puncture resistant; be leak-proof at a hydrostatic pressure of at least thirty-six pounds per square inch; remain leak-proof after a thirty foot drop when filled with water to at least a ninety-eight percent capacity by volume; be transportable by air and by an industry-sized pallet; prevent rapid decompression without a method for pressure relief; and not exceed two hundred pounds in weight. The requirements for a larger container should also permit the use of multiple material components and layers as well as allow for the re-use or replacement of an enclosed bladder and a fabric cylinder.

SUMMARY OF THE INVENTION

Accordingly, it is a general purpose and primary object of the present invention to provide a high strength and comparatively high volume impermeable container.

It is a further object of the present invention to provide a low weight container that can be used for the safe transport of biological and chemically contaminated hazardous contents.

It is a still further object of the present invention to provide a soft transfer case capable of opening to allow the insertion of contents of eighty-five inches by twenty-four inches by eighteen inches with the contents weighing up to three hundred and thirty-five pounds.

It is a still further object of the present invention to provide a soft transfer case capable of being leak-proof at a hydrostatic pressure of thirty-six pounds per square inch and to remain leak-proof after a thirty foot drop at zero degrees Fahrenheit on a flat surface and after an approximately three foot drop on a rigid rod.

In order to attain the objects of the present invention, a robustly constructed container is provided. The container is a soft goods transfer case having a film-laminated, woven synthetic fiber textile exterior layer. The exterior strength layer is a circular woven preform constructed without seams and of continuous warp yarns along a longitudinal axis and continuous weft yarns along a hoop (circumferential) axis. In a final form for use, the soft transfer case is shaped as a soft flexible lay-flat structure similar to a large woven fabric circular air beam.

To prevent air leakage during operation, the soft transfer case has a molded elastomeric bladder containable within the outer circular woven preform. The fabric layer of the woven preform resists expansion when the interior bladder is inflated. The woven preform resembles an open cylinder, and when assembled with the bladder and end clamps, prevents leakage of fluids and gasses.

Such a circular woven preform eliminates lengthwise seams and requires only two mechanical terminations—one termination with end clamps at each end of the circular preform. Also, the structural and air-retention functions are not performed on the same layer with strength of the structure provided by the exterior fabric layer of the preform and air(gas)/fluid retention function provided by the bladder enclosed in the preform. The strength of the transfer case and the air/fluid retention function are intentionally decoupled.

In use, the soft transfer case opens to allow the insertion of significantly larger sized contents of biologically or chemically hazardous materials. After insertion, the transfer case is sealed to protect the materials against drop impact, puncture and rapid decompression. The transfer case will likely never be reopened but is capable of being reopened.

The transfer case of the present invention is puncture resistant and leak proof at a hydrostatic pressure of at least thirty-six pounds per square inch. The container remains leak-proof after a thirty foot drop at thirty-two degrees Fahrenheit on a flat surface and a greater than three foot drop on a rigid rod having a diameter of one and a half inches. The transfer case is also air transportable and resistant to rapid decompression. Furthermore, the transfer case enables the safe repatriation of biologically or chemically contaminated human remains, animal remains, protective equipment or other material in accordance with existing standards of use.

A variant of the soft transfer case of the present invention provides soft end terminations formed by fold-over regions at fold lines in the outer textile strength layer. The strength layer is fitted with matching locking or security straps affixed along a longitudinal exterior of the strength layer. The securing straps are locked together with rings, carabineers, cordage or the like. Lifting handles are also affixed to a longitudinal exterior and a circumference of the outer textile strength in order to ease transport of the soft transfer case.

Ends of the bladder extend outward from fold lines but do not extend to the ends of the outer textile strength layer. That is, each bladder end is contained between an adjacent fold line and a corresponding end of the outer strength layer.

In use and upon pressurization of the bladder (likely by the contaminated or hazardous material in the bladder); the preform of the outer textile strength layer forms a cylindrical shape that is remote from the ends. Further expansion of the bladder is resisted by tension developed across the locking or security straps.

Additional locking straps and optional reinforcement layers constructed of fabric or elastomeric materials may be provided to increase the uniformity of the tensile stresses from the locking straps to the ends and body sections of the circular textile preform. One or more longitudinal retention straps or webbings can be added for strength with the straps positioned along a longitudinal perimeter of the textile preform (when in the ends folded configuration) using alignment loops fixed to the textile layer. The alignment loops prevent the longitudinal retention straps from sliding out of position during loading of the soft transfer case.

BRIEF DESCRIPTION OF THE DRAWINGS

Other objects, features and advantages of the present invention will be better understood by means of a detailed description of the drawings that illustrate the principals of the present invention in which.

DETAILED DESCRIPTION OF THE INVENTION

Figure 1:
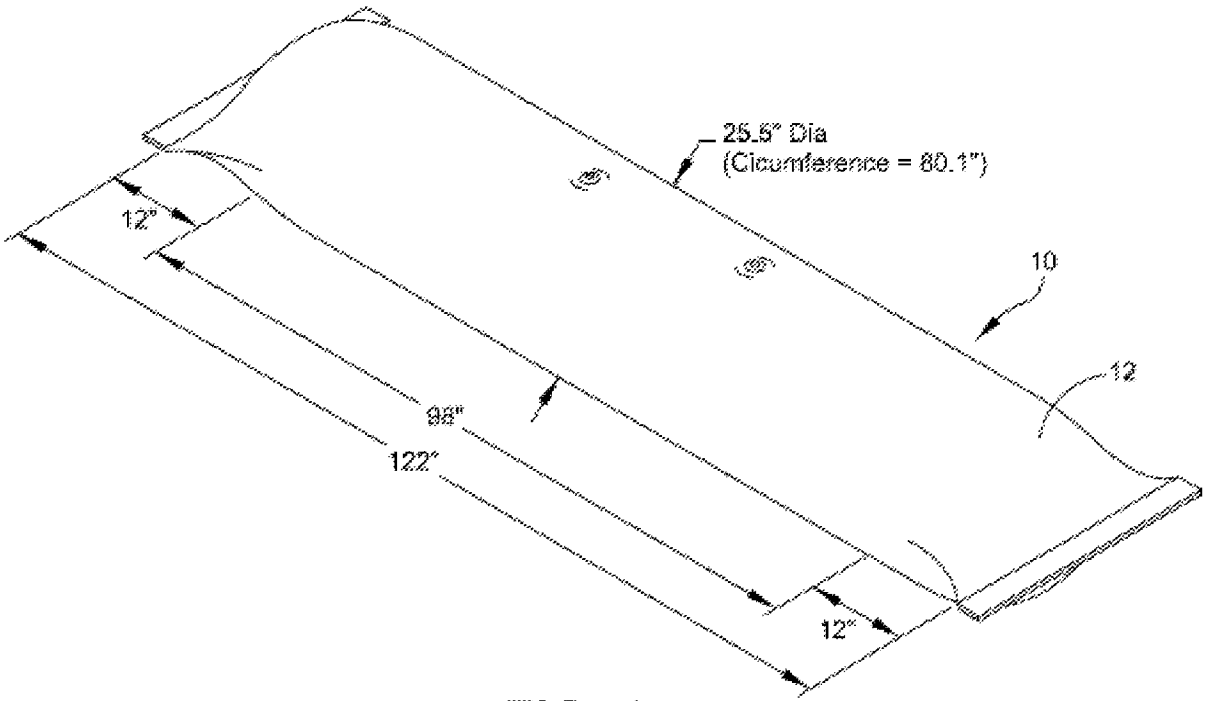
FIG. 1 depicts a dimensioned isometric view of a soft transfer case of the present invention.

Referring now to the drawings, and more particularly to FIG. 1, a soft transfer case 10 with an outer textile strength layer 12 is shown. The twelve-inch dimension in the figure represents the approximate length of a transition of the transfer case 10 from a cylinder to a tapered geometry at mechanical end clamps 20 when the transfer case is subject to an internal pressure. The ninety-eight inch dimension represents the approximate length of a cylindrical region of the transfer case 10 when the transfer case is subject to internal pressure. A preferred overall length of the transfer case 10 is one hundred and twenty-two inches with a circumference of at least eighty inches.

Figure 2:
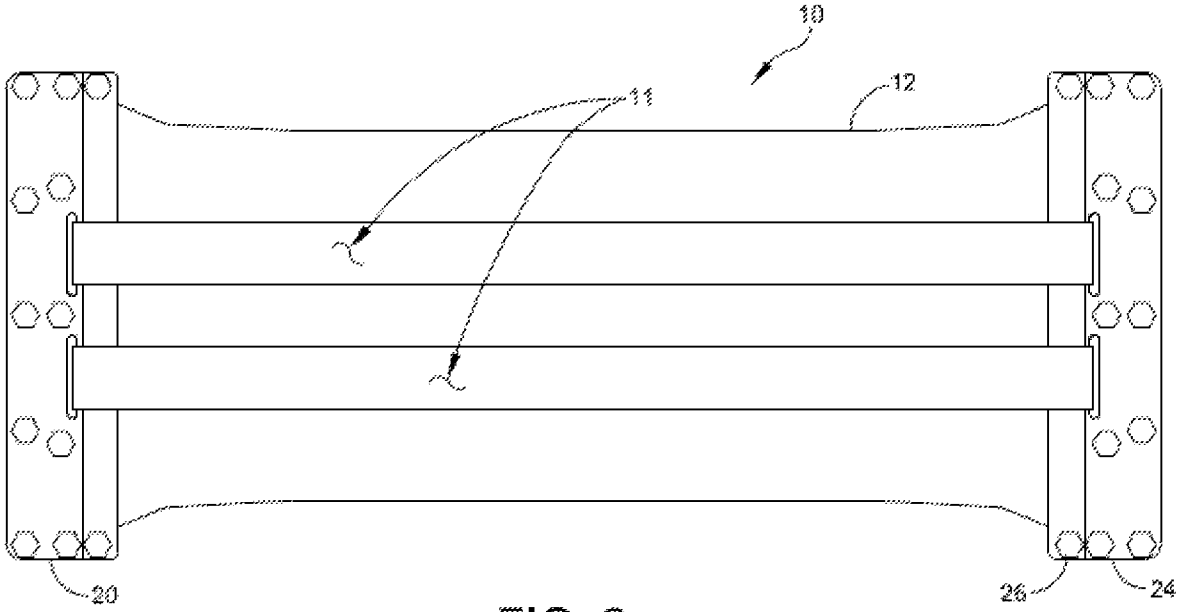
FIG. 2 is a plan view of the soft transfer case of the present invention with longitudinal retention straps and a mechanical clamping assemblies shown.
Figure 3:
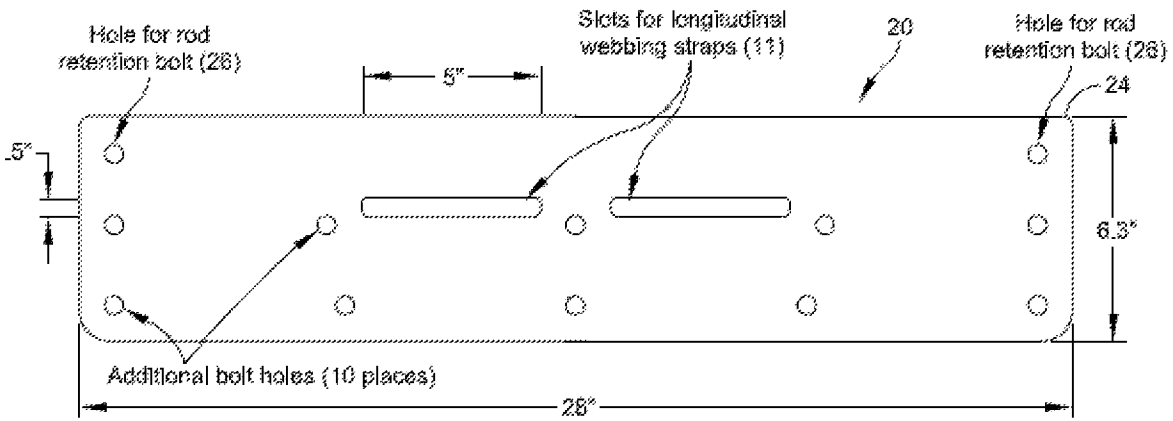
FIG. 3 is a plan view of a mechanical end clamp used to close the soft transfer case of the present invention.
Figure 4:
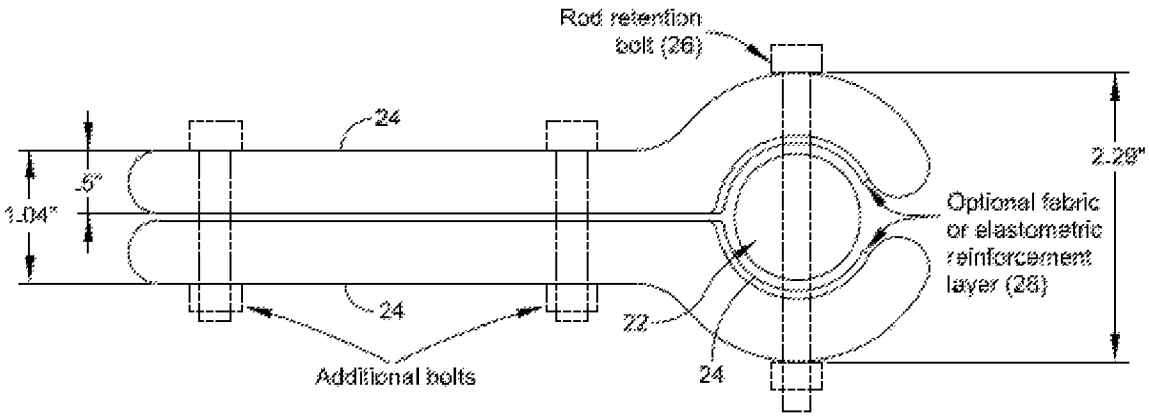
FIG. 4 is a side of the mechanical end clamp of the present invention.

As shown in FIG. 2, the soft transfer case 10 includes longitudinal retention straps 11 with the transfer case secured by the bolted mechanical end clamps 20 (See FIG. 3 and FIG. 4 for additional detail on the end clamps). The longitudinal retention straps 11 are flat webbing, similar to the material of seat belts and can be made of polyester fibers or any other similar structural material. The outer textile strength layer 12 of the transfer case 10 is a continuously woven, circular textile (i.e., Para-aramid synthetic fiber or other high performance fibers) preform layer (See FIG. 5 for additional detail on the fiber arrangement of the preform layer).

In operation, the outer textile strength layer 12 reacts against pressurization; confines volumetric expansion of an internal bladder; and prevents puncture and impact damage. The outer textile strength layer 12 is optionally film laminated or surface coated; however, such a film or coating is only used to protect the fibers from environmental effects and is not to act as the primary bladder for pressure retention purposes. Flexible elastomeric coatings such as urethanes are appropriate for use, provided that the films or coatings behave as flexible membranes. The use of elastomeric films or coatings can be applied to the yarns before weaving or sprayed/brushed on after the soft transfer case 10 is constructed. Laminations are generally only applied to the fabric after weaving.

As shown in FIG. 6A-6E, a layer enclosed by the outer textile strength layer 12 is a separate internal membrane that serves as an oversized (at a size at least fifteen-twenty percent greater than the inflated preform size) impermeable bladder 14 that can provide air retention. The gas/fluid retention member is the oversized bladder 14, specifically the internal membrane of the bladder. After the bladder 14 is positioned inside the outer textile strength layer 12 and upon inflation of the bladder; the expansion of the internal membrane of the bladder is resisted by the outer textile layer.

As shown in FIG. 3 and FIG. 4, end terminations for the outer textile strength layer 12 are each a mechanical clamp 20 constructed of three components. The components are a solid rod 22 fitted within a slotted sleeve formed by clamshell plates 24 and secured by retention bolts 26 or other mechanical fasteners. This type of end clamp has been used successfully for strap-reinforced, braided inflatable air beams designed for military shelters.

Each end of the circular woven preform of the soft transfer case 10 is wrapped over a separate solid rod 22. The slotted sleeve of a clamshell plate 24 is inserted over each rod 22 to secure the preform. The mechanical clamps 20, as shown, do not engage and secure the bladder 14. However, the mechanical clamps 20 can be optionally designed to simultaneously secure the bladder 14 and the outer textile strength layer 12.

Upon pressurization of the bladder 14, the preform of the outer textile strength layer 12 develops a cylindrical form (remote from the ends), as shown by the twelve inch measurements in FIG. 1, which then resists further expansion of the internal bladder. The stresses due to inflation are distributed to minimize concentrations and to avoid failures at rip points. This is an important reason for the fabric design approach of the outer textile strength layer 12 in which maximum stresses occur at the cylindrical region and not at the transition or clamped regions.

A clamping force is generated between the outer textile strength layer 12 and the mechanical clamps 20. The mechanical clamps 20 apply an increasing restraining force upon increasing internal pressure. As shown in FIG. 4, the mechanical end clamp 20 with an optional bonded elastomeric liner 28 assists in reducing stress concentrations in the outer textile strength layer 12 at an interface of the clamp.

Figure 5:
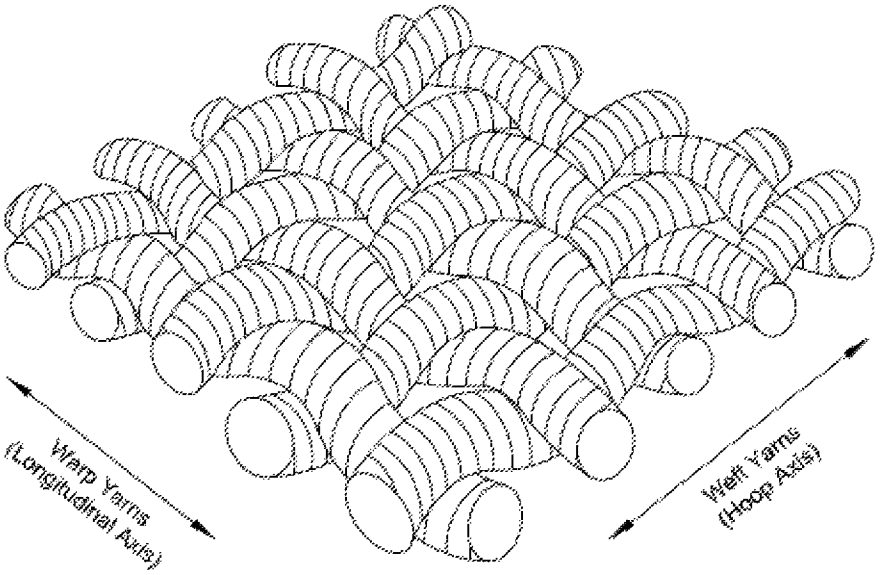
FIG. 5 is a detailed view of the weave pattern for the textile outer layer of the soft transfer case of the present invention.

As shown in FIG. 5, the preform of the outer textile strength layer 12 is formed by using plain-woven and dense fabric architecture. A circular weaving process produces a right-circular cylinder of the outer textile strength layer 12 with open ends and no seams. Dense implies that the plain weave is tightly woven so that light cannot shine through and that pointed objects will not force the yarns to separate (migrate) away from the point of impact or puncture. Denseness of the textile preform is controlled by the number of warp and weft yarns per unit distance of fabric.

In a plain woven fabric, the warp yarns cross over and under consecutive weft yarns. Warp yarns are oriented along the longitudinal axis of the formed cylinder of the outer textile strength layer 12 of the soft transfer case 10. Weft yarns are aligned along the hoop or circumferential direction of the cylinder of the outer textile strength layer 12. As known in the art, warp yarns are in a longitudinal direction and weft yarns are in a hoop or circumferential direction to form the continuous cylindrical structure of the outer textile strength layer 12.

The highly dense, tightly woven fabric achieves a maximum puncture resistance and damage tolerance. A multilayer warp and weft pattern could be used to provide additional protection against puncture and burst. Fabric density increases with increasing numbers of warp yarns per unit circumference and weft yarns per cylinder length. High density tightly woven fabrics restrict relative yarn motions from occurring such that the interstices (spaces between yarns) remain negligible when the outer textile strength layer 12 is mechanically stressed. If the relative yarn motions are significant; the interstices can become sufficiently large; thereby, exposing the internal bladder 14 to potential punctures and impact damage from sharp or pointed objects.

Having a six-thousands of an inch diameter for the yarn is preferred but other diameters are possible with testing. Also, the yarns can be coated to minimize damage from weaving and to provide environmental protection when the soft transfer case 10 is used in field operations. A high performance fiber material is recommended for the fabric. PARA-ARAMID SYNTHETIC FIBER is such a material but other materials exist within this category such as Dimensionally Stable Polyester and VECTRAN (a liquid crystal polymer).

The bladder 14 is molded by using an elastomeric material in a pouch-shaped form having a single open end and is made of elastomeric materials such as urethane, rubber and silicone. The diameter and length of the bladder 14 is approximately ten to thirty percent greater than the diameter and length of the outer textile strength layer 12. This is important because oversizing the bladder 14 prevents the bladder from being subjected to stress when the soft transfer case 10 is pressurized.

Silicone is one of many choices but urethanes can also be used. The selected material of the bladder 14 will be, in general, based upon compatibility with gasses and fluids that are contained in the soft transfer case 10. The elastomeric material must meet the biological and chemical resistance requirements. Silicone and other materials options exist, including thermoplastic urethane.

After molding, the open end of the bladder 14 is rolled up on itself to allow easy insertion of the contaminated materials inside the container. The bladder 14 requires only one seam which is used to permanently seal the open end. Seaming can be done at the point of use by a variety of known methods including heat sealing, adhesive bonding and RF welding.

Figure 6A:
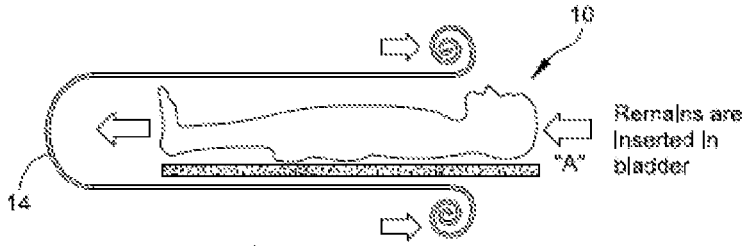
FIG. 6A depicts human remains inserted in the bladder of the soft transfer case of the present invention.
Figure 6B:
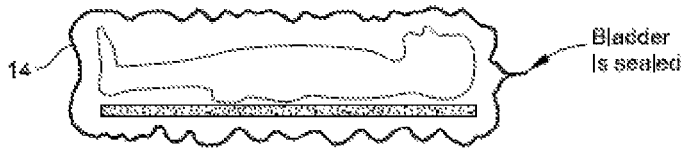
FIG. 6B depicts the bladder of the present invention with human remains inserted and with the bladder closed by sealing.
Figure 6C:
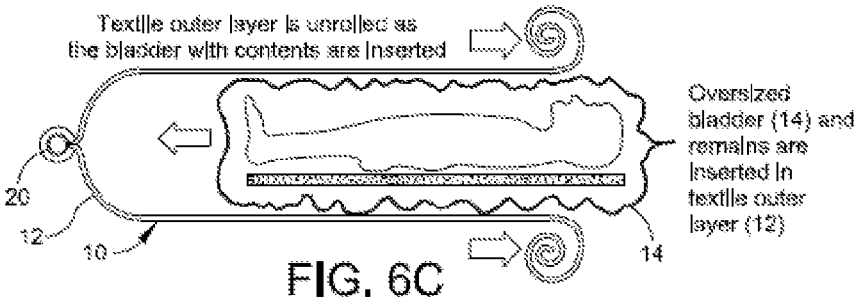
FIG. 6C depicts the bladder of the present invention inserted in the textile outer layer of the present invention.
Figure 6D:
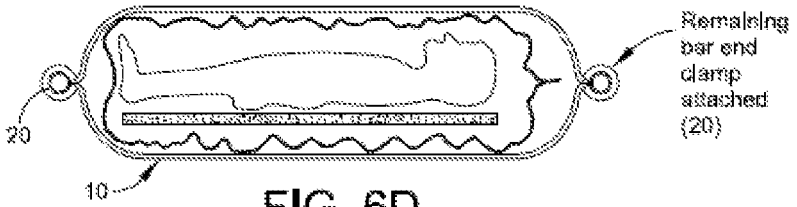
FIG. 6D depicts the textile outer layer of the present invention with the mechanical end clamps attached.
Figure 6E:
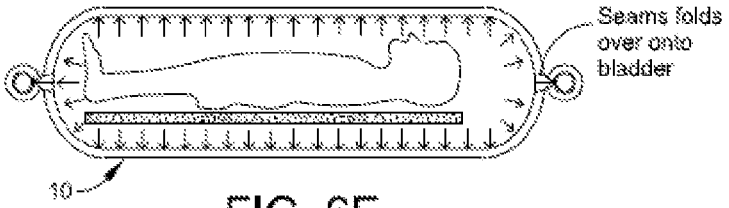
FIG. 6E depicts interior pressure vectors on the textile outer layer of the present invention.

More specifically, the sequence of operation is illustrated in FIGS. 6A-6E in which the bladder 14 is received for field use in a rolled up configuration. As shown in FIG. 6A, the contaminated contents (or human remains) are placed inside the bladder 14 as the bladder is unrolled or after the bladder is unrolled—depending on whatever is easier for the operator or the size of the remains. As shown in FIG. 6B, the bladder 14 is then sealed along the single open end seam and remains unstressed at an ambient pressure (i.e., $p_{internal}=p_{external}$). As shown in FIG. 6C, the bladder 14 with contents is inserted within the outer textile strength layer 12 and in FIG. 6D, the mechanical clamps 20 are attached with a seam of the outer textile layer folding over the bladder. The strength of the mechanical end clamps 20 is greater than the strength of the outer textile strength layer 12 to ensure that the outer layer will fail first.

During air transport, rapid decompression of a closed container can be a dangerous event and must not occur. When using the soft transfer case 10 at high altitudes; a pressure differential can develop such that the bladder 14 becomes internally pressurized as $p_{internal}$ is greater than $p_{altitude}$. The bladder 14 expands with the preform of the outer textile strength layer 12 but does so without stretching. The outer textile strength layer 12 then becomes biaxially stressed along the longitudinal and circumferential directions of the fabric; resists further expansion of the bladder 14; and develops a shape that achieves static equilibrium. Static equilibrium is achieved when inflation causes the soft transfer case 10 to develop biaxial stress states so that a stationary or stable configuration (geometry) does not experience any dynamical effects (flutter, vibration, etc) is produced. The bladder 14 remains unstretched in the presence of the remaining preform with no stresses developed within the bladder.

The preform of the outer textile strength layer 12 resists the bladder 14 from freely expanding. If the bladder 14 is oversized for the volume contained by the outer textile layer 12 then the bladder cannot be subject to stress. The bladder 14 is restricted from straightening out to a full shape by the outer textile or fabric strength layer 12. If the bladder 14 cannot completely straighten out; then the bladder cannot stretch and therefore the bladder cannot experience strain or stress.

Upon pressurization of the bladder 14, the preform of the outer textile strength layer 12 expands and a mechanical restraining force is generated between the textile layer and the mechanical clamps 20. When the bladder 14 is designed not to be secured to the mechanical clamps 20; the bladder simply conforms to the presence of the rod 22.

Several advantages using the chemically/biologically resistant soft transfer case 10 of the present invention include: the decoupling of the structural and air retention functions by utilizing physically and distinct separate layers; the use of an oversized elastomeric bladder 14 that, when inserted inside the smaller outer textile strength layer 12, expands without stretching and therefore does not experience stress with internal pressurization such that air retention performance of the bladder and single seam remain independent of internal pressure; the use of soft good components such as the structural and bladder elements that enable roll-form delivery to point-of-use.

The outer textile strength layer 12 is used as a compliant structural layer that minimizes system weight and that minimizes stress from pressurization (the peak stresses are remote from the ends with stress distributions uniformly distributed remote from the ends). The stresses from drop impacts are less than those produced in conventional rigid structures.

Also, the soft transfer case 10 of the present invention utilizes a woven fabric having orthogonally arranged fiber placement such that the fabric resists lengthwise expansion directly by the longitudinal fibers and therefore does not require the use of tension strap reinforcements although the longitudinal straps 11 are preferably used.

The structural benefits of using a circular woven material for the outer textile strength layer 12 is that upon pressurization, a cylindrical shape is developed and bi-axial stresses are uniformly distributed and remote from the ends. Furthermore, the maximum tensile stress is located in the cylindrical portion of the shape away from the clamped ends and localized stress concentrations and a 2:1 ratio of circumferential to longitudinal stress per unit distance is produced.

Another major advantage of the soft transfer case 10 of the present invention is that the outer textile strength layer 12 can be supplied to the field in roll form. Rolling the outer textile strength layer 12 will minimize logistics, inventory and supply control activities. The proper length of the preform outer textile strength layer 12 can be unrolled and cut to the required length for further use.

Figure 7:
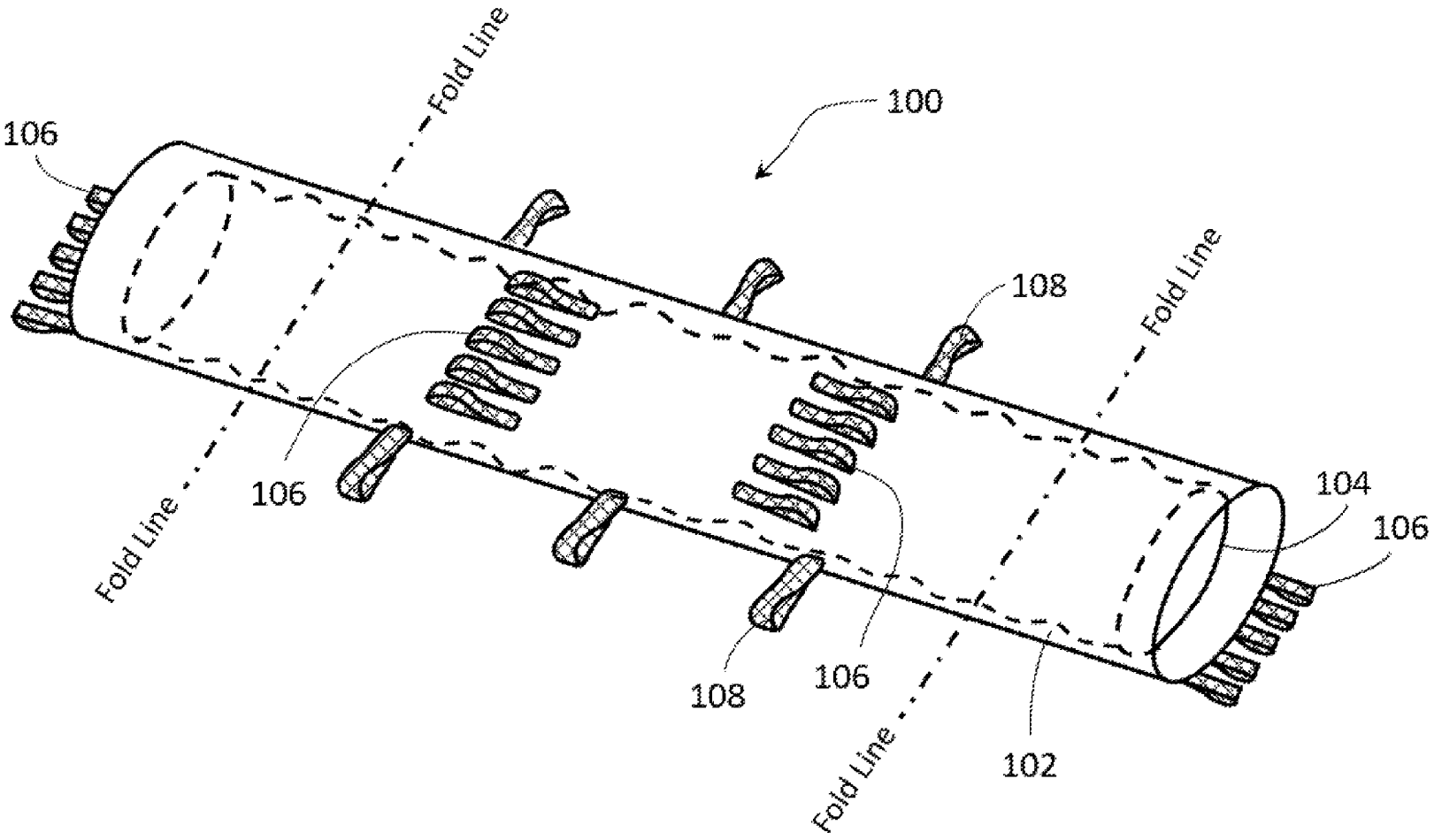
FIG. 7 depicts a soft transfer case as a variant of the embodiment of the present invention in which the transfer case has non-rigid end terminations.

A variant soft transfer case 100 is shown in FIG. 7. Unlike the soft transfer case 10, the variant soft transfer case 100 does not use a rigid clamping device as an end termination.

The first layer of the soft transfer case 100 is an outer textile strength layer 102 comprised of a continuously-woven or braided circular textile preform of high performance fibers. The outer textile strength layer 102 is designed to react against pressurization; confine volumetric expansion of an enclosed and internal bladder 104; and to provide resistance to punctures and impact damage.

The outer textile strength layer 102 can be film-laminated or surface-coated. However, such a film or coating is only used to protect the fibers from environmental effects and is not intended to act as the primary bladder for pressure retention purposes.

The internal bladder 104 can provide air or fluid retention. The bladder 104 can be made of elastomeric materials such as urethane, rubber, silicone, etc. The ends of the bladder 104 extend outward from fold lines of the fold-over regions but do not extend to the ends of the outer textile strength layer 102. That is, each end of the bladder 104 is contained between an adjacent fold line and the corresponding end of the outer textile strength layer 102.

Soft end terminations are formed by fold-over regions fitted with matching locking straps 106 affixed to open ends of the outer textile strength layer 102 as well as in proximity to and on opposite sides of a midpoint axis of the outer textile strength layer. Lifting handles 108 extend in a different direction or circumferentially from the outer textile strength layer 102 as compared to the longitudinal direction of the locking straps 106 on the outer textile strength layer. Additional lifting handles 108 extend from fold-over regions of the soft transfer case 100 as will be shown and referred to in the use of the soft transfer case.

The locking straps 106 are mechanically locked together with rings, carabineers, cordage or the like. The use of soft end terminations is particularly advantageous because the soft transfer case 100 is lighter, less costly and replaces the need for heavy and rigid bar/end clamp device and associated longitudinal reinforcement straps.

In use and upon pressurization of the bladder 104, the textile preform develops a cylindrical shape that is remote from the ends of the soft transfer case 100. The textile preform resists further expansion of the internal bladder 104 by the tension developed across the locking straps 106. Additional locking straps can be added and optional reinforcement layers constructed of fabric or elastomeric materials may be provided to increase the uniformity of the tensile stresses from the locking straps 106 to the ends and body sections of the circular textile preform of the soft transfer case 100.

Additionally, one or more longitudinal retention straps or webbing (not shown) can be used for added strength. These retention straps can be positioned along the longitudinal perimeter of the textile preform (when in the ends-folded configuration) using alignment loops affixed to the outer textile strength layer 102. The alignment loops prevent the longitudinal retention straps from sliding out of position during loading events.

The circular textile preform of the soft transfer case 100 is fabricated using a woven and highly dense fabric architecture. Denseness of the preform is controlled by the number of warp and weft yarns per distance of fabric. Warp yarns are oriented along the longitudinal axis of the soft transfer case 100 and weft yarns are aligned along the hoop or circumferential direction of the soft transfer case.

A highly dense, tightly woven fabric is used to achieve maximum puncture resistance and damage tolerance. Fabric density increases with increasing numbers of warp yarns per unit circumference and weft yarns per unit cylinder length. High density tightly woven fabrics restrict relative yarn motions from occurring such that the interstices (spaces between yarns) remain negligible when the preform is subjected to penetration by pointed impactors or other sharp objects. If the relative yarn motions are significant, the interstices can become sufficiently large thereby exposing the internal bladder to potential punctures and impact damage.

The bladder 104 is molded using an elastomeric material with open ends. The elastomeric material must meet the prescribed chemical and biological resistance requirements for the contents being transported. The bladder 104 requires two seams with each seam adjacent to each end of the preform of the soft transfer case 100. Sealing of the ends of the bladder 104 can be accomplished by a variety of methods including heat sealing, adhesive bonding, welding, etc.

Figure 8A:
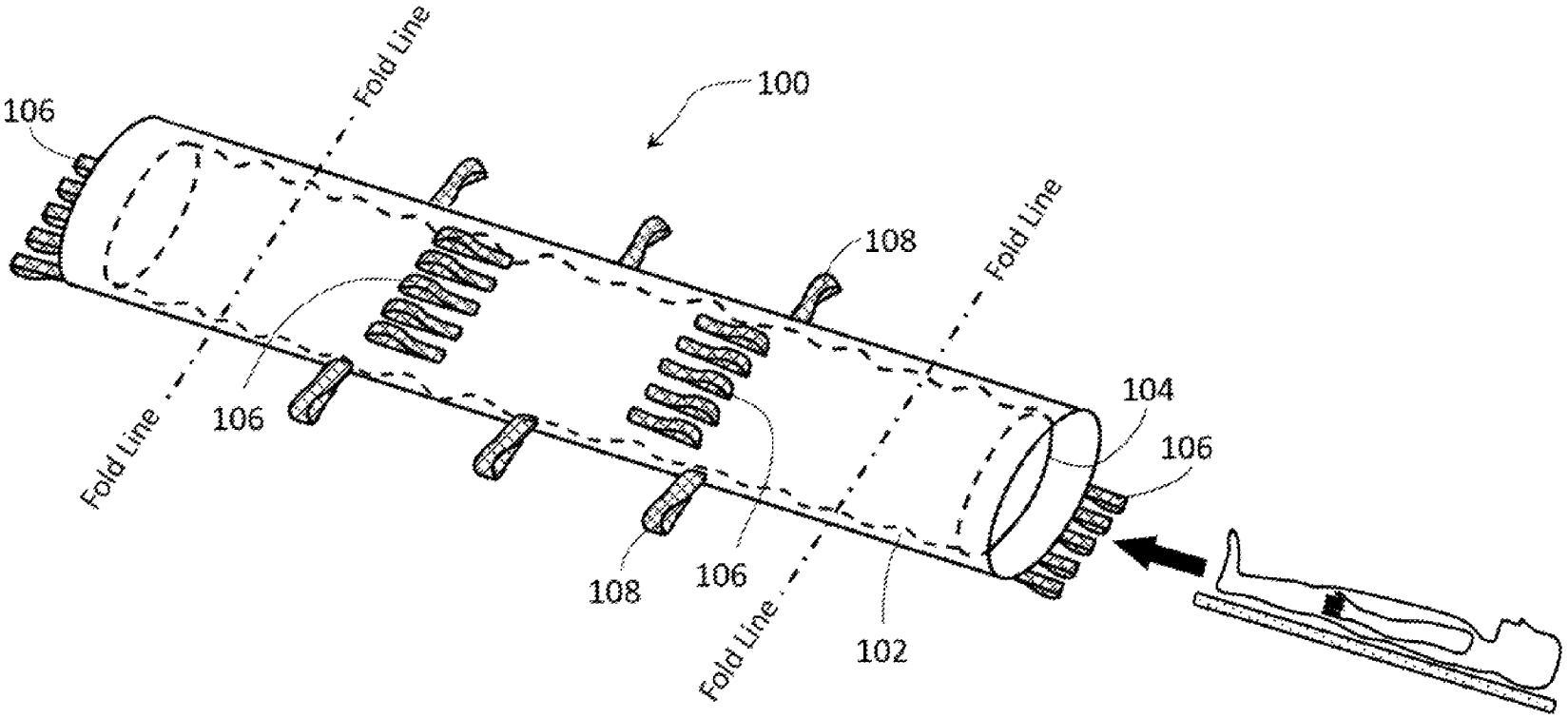
FIG. 8A depicts human remains inserted in the bladder of the variant of the soft transfer case of the present invention.
Figure 8B:
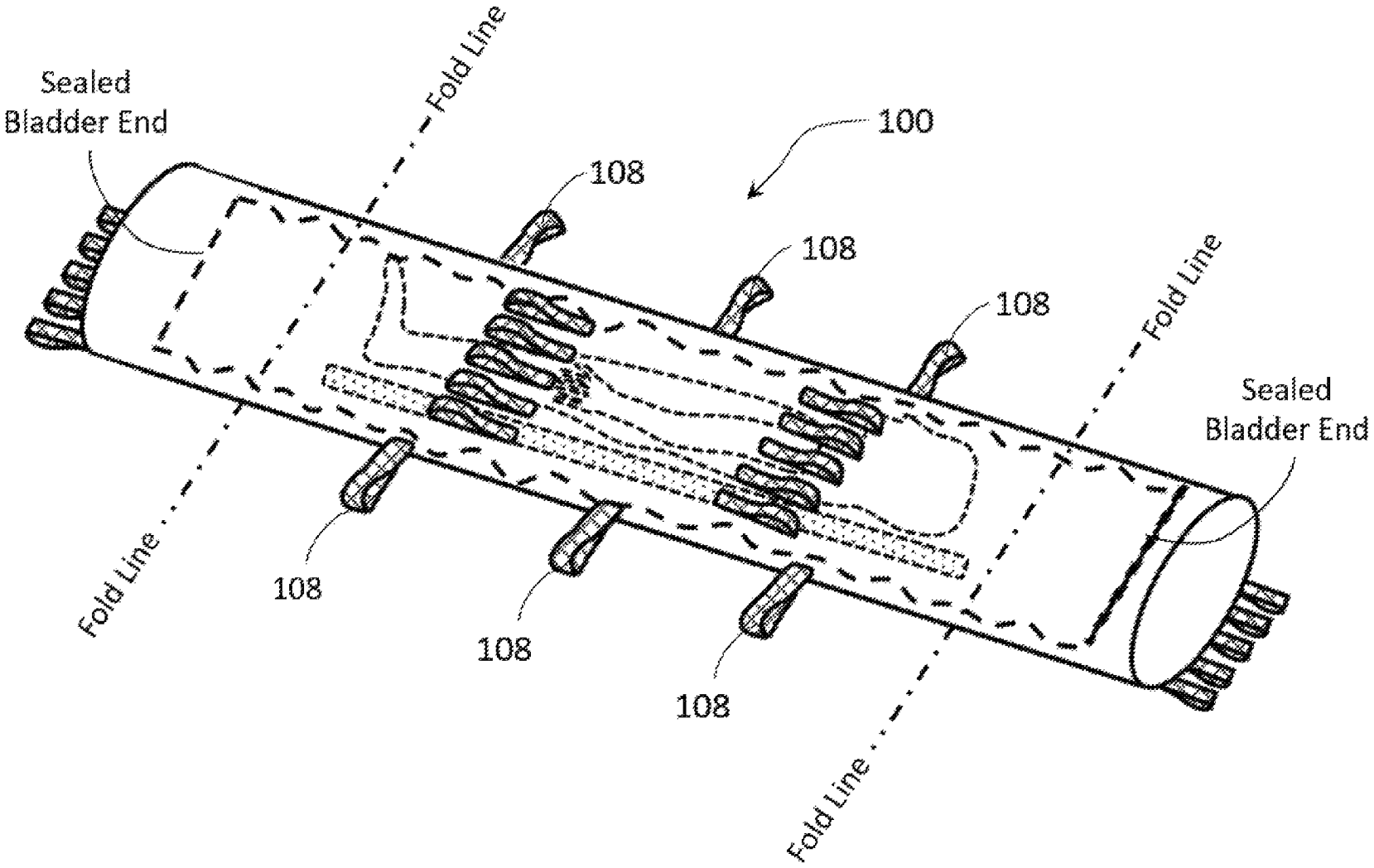
FIG. 8B depicts the bladder of the variant with human remains inserted and with the bladder closed by sealing.
Figure 8C:
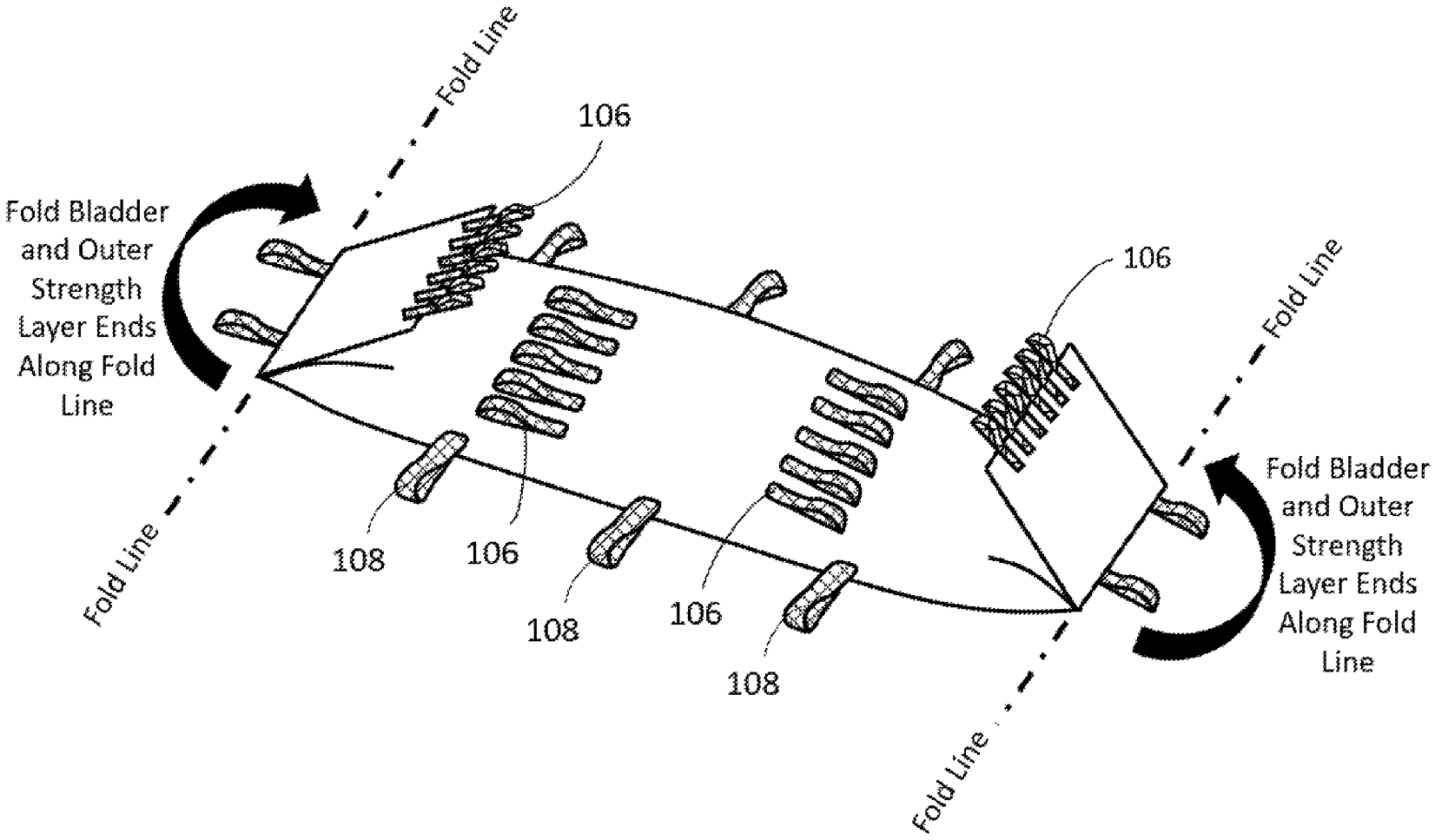
FIG. 8C depicts the bladder and outer strength layer folded at both ends of the soft transfer case.
Figure 8D:
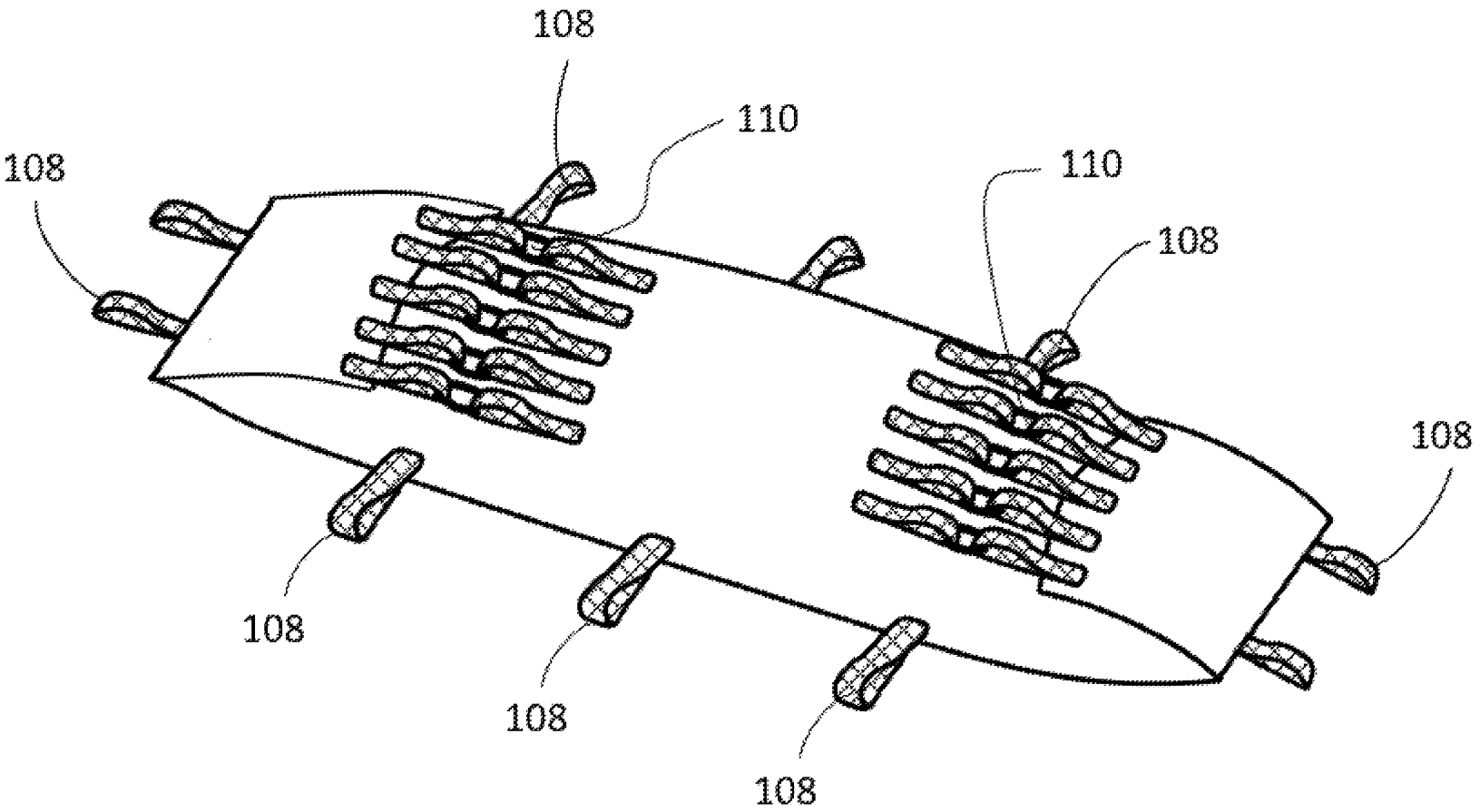
FIG. 8D depicts the textile outer strength layer of the present invention with securing rings attached.

More specifically, the sequence of operation is illustrated in FIGS. 8A-8E in which the bladder 104 is received for field use in a rolled up and cut-for-length configuration. As shown in FIG. 8A, the contaminated contents (or human remains) are placed inside the bladder 104 as the bladder is unrolled or after the bladder is unrolled—depending on whatever is easier for the operator or depending on the size of the remains. As shown in FIG. 8B, the bladder 104 is then sealed along the open end seams and remains unstressed at an ambient pressure with the contents inserted within the outer textile strength layer 102. In FIG. 8C and FIG. 8D, the soft transfer case 100 is then folded along the designated fold lines and the locking straps 106 are secured together using rings (carabineers) 110 to contain the bladder 104. The lifting handles 108 are then used to ease the transport of the soft transfer case 100.

During air transport, rapid decompression of a generally large and closed container can be a dangerous event and must not occur. Considering the soft transfer case 100 at high altitudes, a pressure differential can develop such that the bladder 104 becomes internally pressurized. The oversized bladder 104 expands within the outer textile strength layer 102 but does so without stretching. The textile preform becomes bi-axially stressed, resists further bladder expansion and develops a shape that achieves static equilibrium.

Because the oversized bladder 104 remains unstretched at all times in the presence of the restraining textile preform; no in-plane stresses are developed in the bladder. The textile preform of the outer textile strength layer 102 prevents the bladder 104 from fully straightening such that the bladder is not permitted to stretch. Upon pressurization of the bladder 104, the textile preform expands and a mechanical restraining force is generated between the preform and the locking straps by the mechanical rings, carbineers, cordage, etc.

Advantages of the soft transfer case 100 include: the decoupling of the structural and air (fluid or solid) retention functions by the use of physically and distinctly separate layers; the use of an oversized elastomeric bladder that, when inserted into the smaller textile preform of the outer strength layer, expands without stretching and therefore does not experience in-plane stress with internal pressurization such that air retention performance of the bladder and end seams remains independent of internal pressure; the use of soft-good components such as the structural and bladder elements enables roll-form delivery to point-of-use; and the use of a circular textile preform as a compliant structural layer that minimizes weight, minimizes stress from pressurization (peak stresses are remote from the ends such that stress distributions are uniformly distributed remote from the ends), and stressed developed during drop impact events are less than those produced within conventional rigid structures.

The soft transfer case 100 utilizes a continuously circular woven fabric preform having orthogonally arranged fiber placement such that lengthwise expansion is directly resisted by the longitudinal fibers and therefore does not require the use of tension strap reinforcements to resist longitudinal tensile stresses developed by internal pressurization. Furthermore, the soft end termination capability of the soft transfer case 100 eliminates the bulkiness and weight of rigid clamping and therefore allows for faster field processing and operations without the need for tools.

The textile preform of the outer textile strength layer 102 can be fabricated using a variety of seamless textile fabric architecture (plain, twill, satin-woven, etc.) and fiber materials such as but not limited to nylon, ultra-high molecular weight polyethylene, polyester, liquid crystal polymer, etc. For increased burst and puncture strengths and improved resistance to environmental effects; the circular textile preform may be constructed of multiple layers of identical or different textile architectures and materials.

The internal oversized bladder 104 can be molded from various elastomers such as urethane, rubber, silicone, etc. provided that the material is compatible for containing the contaminated agents. The ideal bladder seaming process will depend on the selected bladder material but methods include adhesive bonding, heat sealing, RF welding and others may be suitable.

Additional fabric or elastomeric reinforcement layers may be locally employed in the vicinity of the fold-over regions to improve the distribution of the locking strap tension forces over the fold-over ends and body portions of the textile preform. A single longitudinal retention strap or multiple longitudinal retention straps can be optionally used to provide additional support to the locking straps. Other methods for securing the locking straps together beyond the mechanical rings, carabineers, and cordage may include stitching, riveting, bonding etc. of the locking strap pairs.

The soft transfer case 100 has the ability to support multiple bladders for different hazardous materials within a single transfer package. The soft transfer case is scalable and capable of use across many industrial, commercial, consumer and military markets. The soft transfer case provides further utility for use as towable bladders (also known as dracone barges) for sea transport of bulk fluids.

Yet another use of the soft transfer case is as a deployable and flexible escape pod for use by undersea divers, astronauts, emergency responders, marine workers, etc. When used as an escape pod, the bladder is filled with air and optional scuba tanks to enable the safe and short-term transport of one or more occupants.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A reusable soft transfer case for containing biological and chemical material, said soft transfer case comprising:

an elastomeric bladder with an open end including a sealing component wherein said bladder is capable of containing the material and forming a seam at said sealing component once the material is contained;

an outer textile strength layer enclosing said bladder to be in movable contact with said bladder, said outer layer being a continuously woven textile preform cylindrical layer having a first open end and a second open end with both open ends extending beyond a length of said bladder;

a first plurality of ringlet locking straps affixed in parallel to each other and extending from the first open end of said outer textile strength layer with said first plurality of ringlet locking straps parallel to a longitudinal axis of said soft transfer case;

a second plurality of ringlet locking straps affixed in parallel to each other and extending from said outer textile strength layer with said second plurality of ringlet locking straps also parallel to the longitudinal axis of said soft transfer case and on a first side of a midpoint axis of said soft transfer case wherein the midpoint axis is perpendicular to the longitudinal axis such that said first plurality of ringlet locking straps and said second plurality of ringlet locking straps are on the first side of the midpoint axis;

a third plurality of ringlet locking straps affixed in parallel to each other and extending from said outer textile strength layer with said third plurality of ringlet locking straps also parallel to the longitudinal axis of said soft transfer case and on a second side of the midpoint axis of said soft transfer case;

a fourth plurality of ringlet locking straps affixed in parallel to each other and extending from the second open end of said outer textile strength layer with said fourth plurality of ringlet locking straps also parallel to the longitudinal axis of said soft transfer case such that said third plurality of ringlet locking straps and said fourth plurality of ringlet locking straps are on the second side of the midpoint axis; and a first plurality of lifting handles extending perpendicular from the outer textile strength layer in relation to and in proximity to said second plurality of ringlet locking straps and said third plurality of ringlet locking straps;

wherein said first plurality of ringlet locking straps is capable of being secured to said second plurality of ringlet locking straps by mechanical locking devices such that a first fold-over region with a first fold line is formed;

wherein said third plurality of ringlet locking straps is capable of being secured to said fourth plurality of ringlets by mechanical locking devices such that a second fold-over region with a second fold line is formed;

wherein soft end terminations are formed at ends of the first fold line of the first fold-over region and the second fold-line of the second fold-over region.

2. The soft transfer case of claim 1, wherein said soft transfer case further comprises:

a second plurality of lifting handles affixed to said outer textile strength layer between said first plurality of ringlet locking straps and said second plurality of ringlet locking straps on a side of said outer textile strength layer opposite to said second plurality of ringlet locking straps such that said second plurality of lifting handles is on an exterior of the first fold-over region in proximity to the first fold-line; and a third plurality of lifting handles affixed to said outer textile strength layer between said third plurality of ringlet locking straps and said fourth plurality of ringlet locking straps on a side of said outer textile strength layer opposite to said third plurality of ringlet locking straps such that said third plurality of lifting handles is on an exterior of the second fold-over region in proximity to the second fold-line.

3. The soft transfer case of claim 2, wherein said outer textile layer is surface coated.

4. The soft transfer case of claim 3, wherein the material of said outer textile layer is Para-aramid synthetic fiber.

5. The soft transfer case of claim 4, wherein the material of said bladder is silicone.

6. The soft transfer case of claim 5, wherein said outer textile layer is formed by using plain-woven fabric architecture with warp yarns crossing over and under consecutive weft yarns wherein the warp yarns are oriented along a longitudinal axis of said cylindrical layer and weft yarns are aligned along a circumferential direction of said cylindrical layer.

* * * * *